US005357718A

United States Patent [19]

Kanno

[11] Patent Number: 5,357,718

[45] Date of Patent: Oct. 25, 1994

[54] WAFER RINSING APPARATUS

[75] Inventor: Itaru Kanno, Hyogo, Japan

[73] Assignee: Mitsubishi Denki Kabushiki Kaisha, Tokyo, Japan

[21] Appl. No.: 45,162

[22] Filed: Apr. 12, 1993

[30] Foreign Application Priority Data

Oct. 19, 1992 [JP] Japan ..... 4-279915

[51] Int. Cl.[5] ..... B24C 3/32

[52] U.S. Cl. ..... 451/75; 451/96; 451/38; 451/39

[58] Field of Search ..... 51/320, 322, 319, 321, 51/410, 356, 436

[56] References Cited

U.S. PATENT DOCUMENTS 4,932,168 6/1990 Tada et al. ..... 51/436
5,035,750 7/1991 Tada et al. ..... 134/7
5,129,198 7/1992 Kanno et al. ..... 51/424

FOREIGN PATENT DOCUMENTS 0120978 6/1987 Japan ..... 51/322

*Primary Examiner*—Robert A. Rose
*Attorney, Agent, or Firm*—Lowe, Price, LeBlanc & Becker

[57] ABSTRACT

A wafer rinsing apparatus includes an ice making hopper for making ice particles by heat exchange between fine droplets of liquid to be frozen and low-temperature liquefied gas. The ice making hopper is connected to a separation device for separating the ice particles and vaporized gas generated from the low-temperature liquefied gas. The ice particles separated by the separation device are jetted onto a wafer by a jetting device, thereby rinsing the surface of the wafer.

4 Claims, 6 Drawing Sheets

WAFER RINSING APPARATUS

BACKGROUND OF THE INVENTION

1. Field of the Invention

The present invention relates generally to wafer rinsing apparatuses, and more particularly, wafer rinsing apparatuses with improved rinsing effects.

2. Description of the Background Art

Manufacturing processes of super large scale integrated circuit devices of the time demand a more efficient technique of rinsing wafer surface in order to improve a yield and quality of the devices. Contaminants such as resist residues, fine particles, organic films and native oxide films are among principal factors which determine a yield and performance of devices. For submicron devices, contaminated particles on the order of 0.1 μm should be removed.

FIG. 5 is a schematic diagram showing a conventional wafer rinsing apparatus for rinsing a wafer by jetting ice particles on the wafer.

The conventional wafer rinsing apparatus includes an ice making hopper 1 for making ice particles by heat exchange between fine droplets of liquid to be frozen and low-temperature liquefied gas. Ice making hopper 1 is provided with a supply spray 2 for supplying fine droplets of liquid to be frozen to ice making hopper 1. The liquid to be frozen with particles removed by a filter 3 is fed to supply spray 2. Ice making hopper 1 is provided with a supply spray 4 of low-temperature liquefied gas (hereinafter simply referred to as liquefied gas). The liquefied gas is fed to supply spray 4 through a filter 5. Supply spray 4 and filter 5 are connected by a piping 20. Ice making hopper 1 is coupled to a spray means 9. Jet nozzle 9 is arranged in a washing vessel 7. A wafer 6 is disposed in washing vessel 7. With reference to FIGS. 5 and 6, wafer 6 is held and rotated by a roller 8. Provided in washing vessel 7 is a pure water nozzle 10 for spraying pure water onto the surface of wafer 6.

Operation of the conventional wafer rinsing apparatus will be described. Particles included in liquefied gas such as liquid nitrogen are removed by filter 5. The liquefied gas with particles removed is fed to ice making hopper 1 by supply spray 4, thereby cooling ice making hopper 1 to about −100° C.−−150° C. Then, particles included in liquid to be frozen such as pure water are removed by filter 3 and the pure water with the particles removed is supplied to the ice making hopper by supply spray 2. The supply of the liquefied gas and that of the liquid to be frozen to ice making hopper 1 are carried out substantially at the same time. The fine droplets of the liquid to be frozen are made into ice particles 30 by heat exchange with the liquefied gas. The liquefied gas supply sprays 4 are provided in plural in order to efficiently execute the heat exchange. The liquefied gas is sprayed into ice making hopper 1 and vaporized therein. Heat of the vaporization is used to make the fine droplets of liquid to be frozen into ice particles 30. The diameter of the obtained ice particles is several μm–50 μm. Ice making hopper 1 is made of SUS materials and filter 3 is made of SUS materials or ceramic materials. Ice particles 30 formed in ice making hopper 1 are drawn by jet nozzle 9 disposed in washing vessel 7 and sprayed onto wafer 6. Jet nozzle 9 is formed by an ejector using dry air or nitrogen gas as a carrier gas.

Wafer 6 is held by roller 8 provided in washing vessel 7. When the ice particles 30 are jetted, wafer 6 is moved up-and-down and rightward and leftward and rotated by roller 8, so that the ice particles 30 are jetted onto the entire surface of wafer 6. In addition, pure water is sprayed onto wafer 6 from pure water nozzle 10 in order to enhance a rinsing effect when the ice particles 30 are jetted.

With the conventional wafer rinsing apparatus thus structured as shown in FIG. 5, dusts are formed at piping 20, ice making hopper 1, supply spray 4 and filter 5 which contact with the liquefied gas, whereby particles such as Fe, Ni and Cr having a diameter smaller than that of the ice particles are formed. The particles, together with the ice particles 30, are jetted onto wafer 6 to contaminate and damage the same.

The mechanism of dust formation is as follows. When liquid nitrogen contacts an inner wall surface of an ice making hopper made of the SUS materials, for example, the liquid nitrogen is vaporized on the inner wall surface of the ice making hopper to suddenly expand the hopper. Such sudden expansion peels off particles of such as Fe, Ni and Cr from the SUS materials to form dusts.

SUMMARY OF THE INVENTION

The present invention aims at providing a wafer rinsing apparatus improved to reduce dusts as described above.

The present invention also aims at providing a wafer rinsing apparatus improved to prevent dusts of particles from being jetted onto the wafer.

A wafer rinsing apparatus according to one aspect of the present invention includes an ice making hopper for making ice particles by heat exchange between fine droplets of liquid to be frozen and low-temperature liquefied gas. Connected to the above-described ice hopper is a separation means for separating the above-described ice particles and liquefied gas generated from the above-described low-temperature liquefied gas. The apparatus includes jetting means for jetting the above ice particles separated by the above separation means onto the wafer to rinse the surface of the wafer.

According to a preferred embodiment of the present invention, the above-described separation means includes a cyclone.

A wafer rinsing apparatus according to another aspect of the present invention includes an ice making hopper for making ice particles by heat treatment between fine droplets of liquid to be frozen and low-temperature liquefied gas. Attached to the above ice making hopper is a liquid to be frozen supplying means for supplying the above fine droplets of the above liquid to be frozen to the ice making hopper. Attached to the above ice making hopper is a filter means for removing particles included in the above low-temperature liquefied gas supplied to the ice making hopper. The above filter means is coupled to a supply piping for supplying the low-temperature liquefied gas to the above ice making hopper with the filter means provided therebetween. The apparatus includes a jetting means for jetting the above ice particles formed by the above ice making hopper onto the wafer. The apparatus further includes a cooling means for externally cooling the above filter means and the above supply piping down to the liquefidation temperature of the above low-temperature liquefied gas.

In the wafer rinsing apparatus according to said one aspect of the present invention which includes the separation means for supplying ice particles and evaporated gas generated from low-temperature liquefied gas, particles formed from dusts are removed together with evaporated gas and separated from the ice particles. Therefore, no particle formed from the dust is mixed in the ice particles.

In the wafer rinsing apparatus according to said another aspect of the present invention which includes a cooling means for externally cooling the ice making hopper, the filter means and the supply piping down to the liquefidation temperature of the low-temperature liquefied gas, contact between these components and the liquefied gas will not suddenly expand the liquefied gas. Dust formation is therefore suppressed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

One embodiment of the present invention will be described in the following with reference to the drawings.

Figure 1:
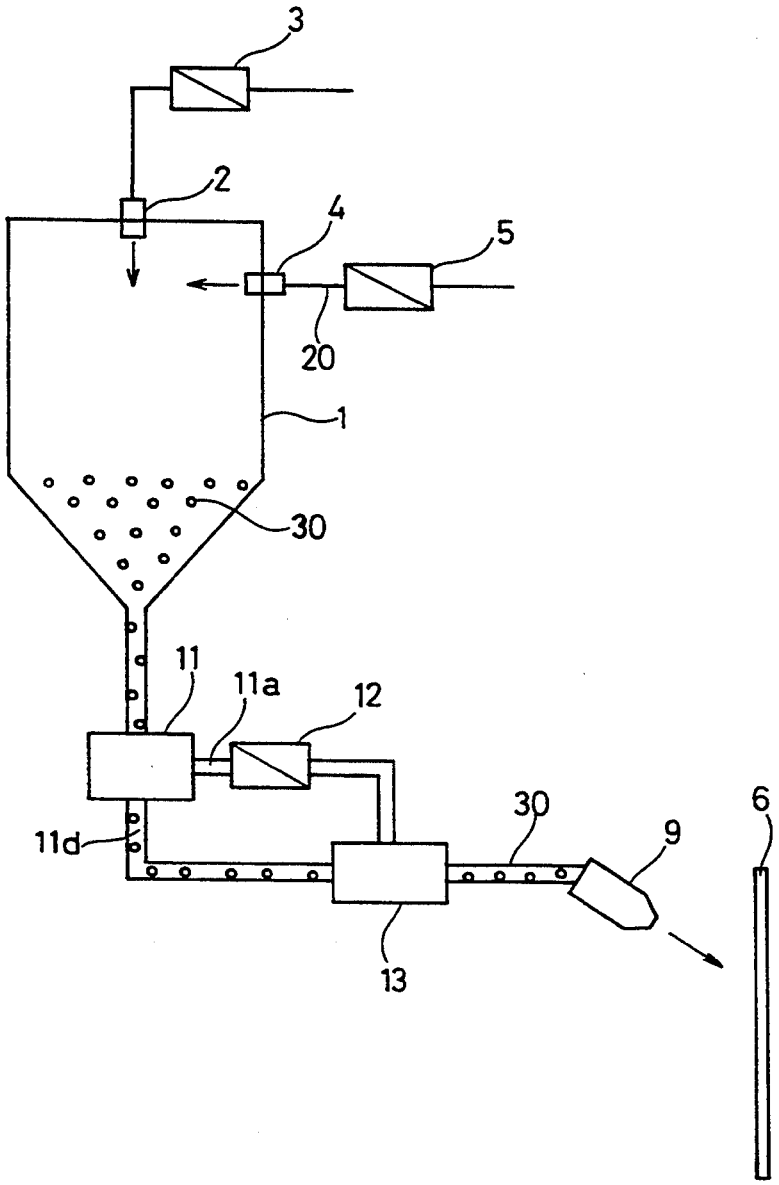
FIG. 1 is a schematic diagram showing a wafer rinsing apparatus according to one embodiment of the present invention.

FIG. 1 is a schematic diagram showing a wafer rinsing apparatus according to one embodiment of the present invention. The wafer rinsing apparatus of the present embodiment includes an ice making hopper 1 for making ice particles by heat exchange between fine droplets of liquid to be frozen and a low-temperature liquefied gas. Ice making hopper 1 is provided with a supply spray 2 for supplying the liquid to be frozen to ice making hopper 1. Supply spray 2 is supplied with the liquid to be frozen through a filter 3. Ice making hopper 1 is provided with a supply spray 4 for supplying the low-temperature liquefied gas to ice making hopper 1. Supply spray 4 is supplied with the low-temperature liquefied gas through a filter 5. Ice making hopper 1 is provided with a separation means 11 for separating ice particles 30 and vaporized gas generated from the low-temperature liquefied gas. The structure of the separation means 11 will be described later. Attached to separation means 11 is a filter 12 which is a means for removing particles from the vaporized gas separated by the separation means. Attached to separation means 11, filter 12 and a jet nozzle 9 is a mixing means 13 for mixing the ice particles 30 separated by separation means 11 with the vaporized gas with the particles removed by filter 12 and feeding the mixture to jet nozzle 9.

Figure 2:
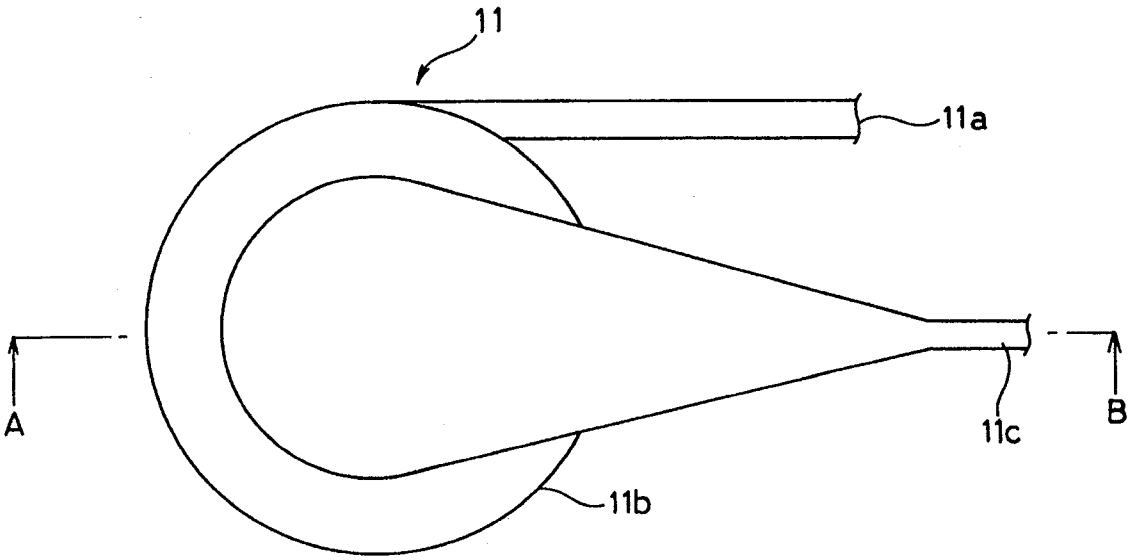
FIG. 2 is a plan view showing a mixing means adopted by the present embodiment.
Figure 3:
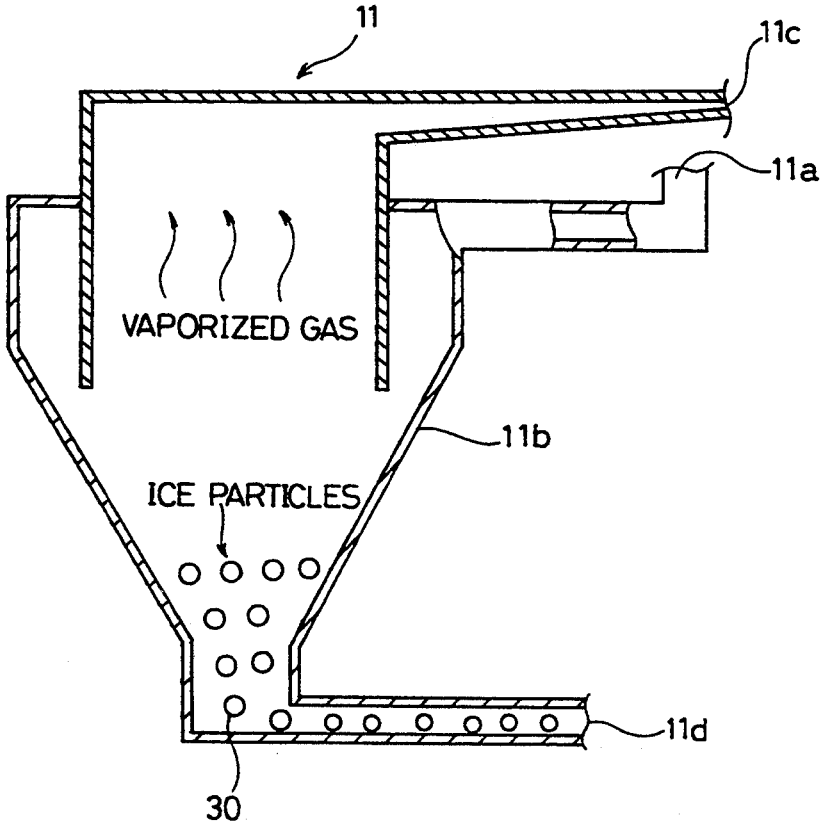
FIG. 3 is a sectional view taken along line A–B of FIG. 2.

Separation means 11 will be described in detail with reference to FIGS. 2 and 3. FIG. 2 is a plan view of the separation means and FIG. 3 is a sectional view taken along line A–B of FIG. 2. The illustrated separation means is called a cyclone.

In this apparatus, centrifugal force is applied by a rotating flow in a cylinder **11*b* to the mixture of the ice particles 30 and the vaporized gas fed through an inlet 11*a*. The centrifugal force separates the vaporized gas and the ice particles 30. The vaporized gas is exhausted through a vaporized gas outlet 11*c*, while the ice particles are discharged through an ice particle outlet 11*d***.

Back to FIG. 1, for example, an ejector is used as mixing means 13.

Operation will be described in the following.

The mixture of the ice particles 30 and the vaporized gas before entering separation means 11, includes particles, that is, dusts. As is already described, the dusts are formed as a result of contact between the SUS materials used for ice making hopper 1, supply spray 4, filter 5 and piping 20 for liquefied gas, and low-temperature liquefied gas. When these mixtures including dusts enter separation means 11, most of the dusts are discharged through vaporized gas outlet **11*a* together with the vaporized gas as shown in FIG. 3**.

Back to FIG. 1, the dusts included in the vaporized gas are removed by filter 12. The vaporized gas with the dusts removed is mixed with the ice particles 30 fed through ice particle outlet **11*d* in mixing means 13. The ice particles 30 and the vaporized gas mixed in mixing means 13 are fed to jet nozzle 9 and jetted onto a wafer 6**.

According to the present embodiment, the mixture of the ice particles 30 and the vaporized gas fed to jet nozzle 9 barely includes dust, whereby the effect of rinsing wafer 6 is enhanced.

Efficiency of roving dusts included in the ice particles 30 and the vaporized gas formed in ice making hopper 1 is determined by a separation efficiency of separation means 11 and an efficiency of filter 12 of capturing dusts.

Figure 4:
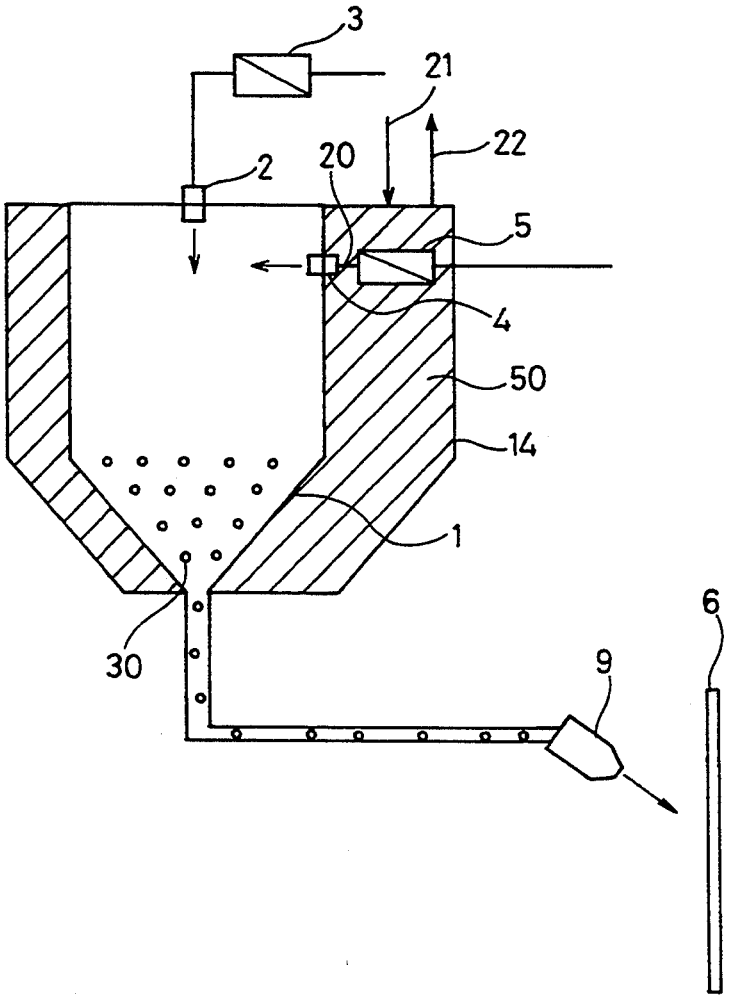
FIG. 4 is a schematic diagram showing a wafer rinsing apparatus according to another embodiment of the present invention.
Figure 5:
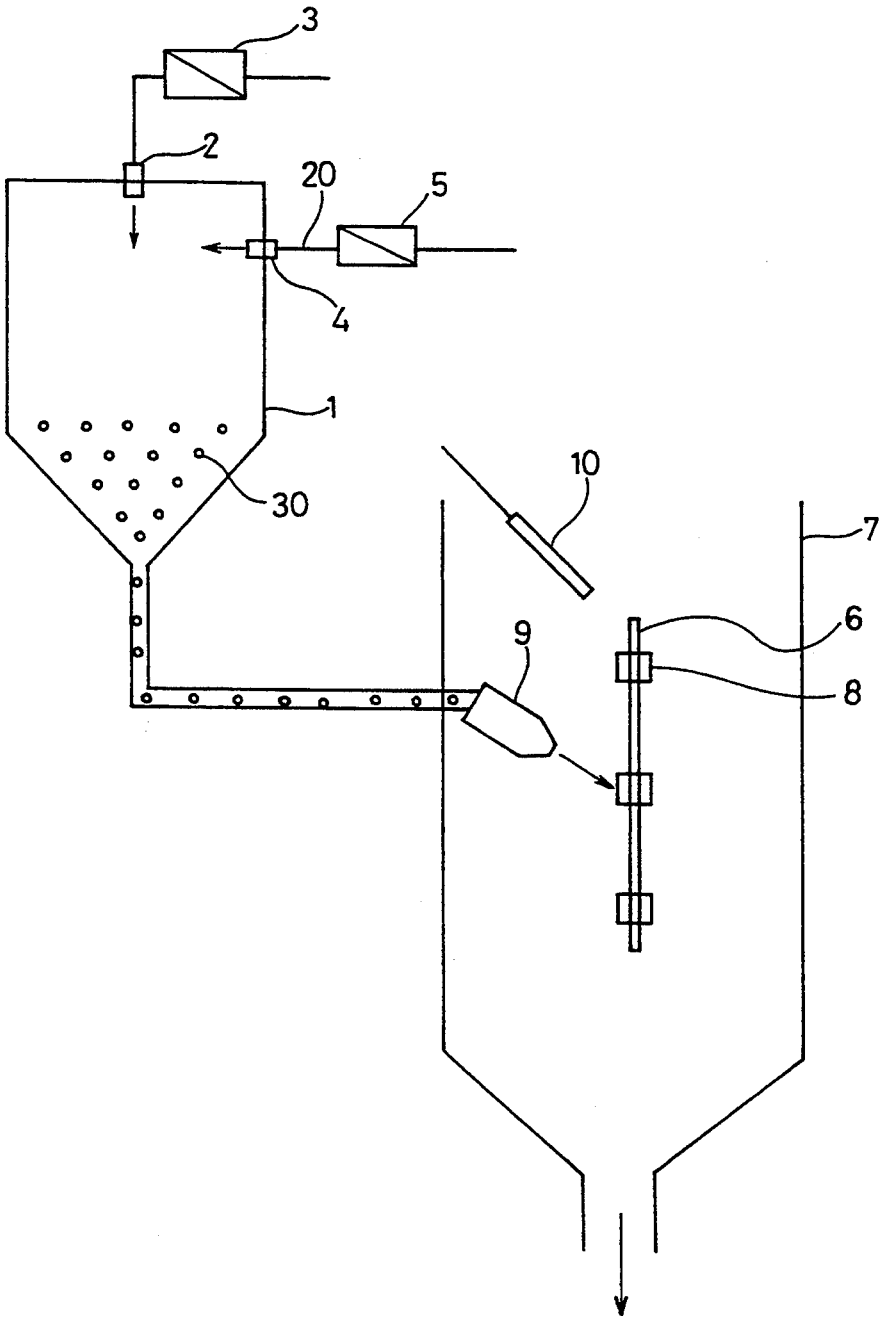
FIG. 5 PRIOR ART
FIG. 5 is a schematic diagram showing a conventional wafer rinsing apparatus.
Figure 6:
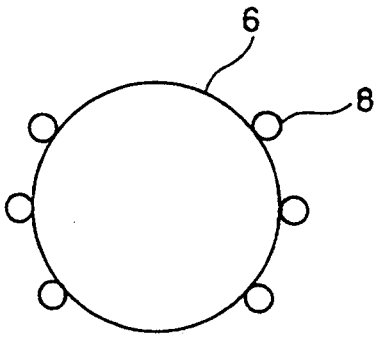
FIG. 6 PRIOR ART
FIG. 6 is a plan view showing a roller which supports a wafer.

FIG. 4 is a schematic diagram showing a wafer rinsing apparatus according to another embodiment of the present invention.

The apparatus of the present embodiment includes an ice making hopper 1 for making ice particles 30 by heat exchange between fine droplets of liquid to be frozen and a low-temperature liquefied gas. Ice making hopper 1 is provided with a supply spray 2 for supplying the liquid to be frozen to ice making hopper 1. Supply spray 2 is supplied with the liquid to be frozen, that is, pure water which has passed through a filter 3. Ice making hopper 1 is provided with a supply spray 4 for supplying the low-temperature liquefied gas to ice making hopper. Supply spray 4 is supplied with the low temperature liquefied gas which has passed through a filter 5. Supply spray 4 and filter 5 are connected by a supply piping 20. The apparatus includes a cooling chamber 14 provided to surround ice making hopper 1, supply spray 4, filter 5 and supply piping 20. Cooling chamber 14 is filled with low-temperature liquefied gas 50, so that ice making hopper 1, supply spray 4, the filter and supply piping 20 are cooled down to the liquefidation temperature of the low-temperature liquefied gas. The low-temperature liquefied gas enters cooling chamber 14 through a supply inlet 21, while the vaporized gas is exhausted through an outlet 22. Since ice making hopper 1, supply spray 4, filter 5 and supply piping 20 are cooled down to the liquefidation temperature of the low-temperature liquefied gas in the apparatus according to the present embodiment, contact of the low-temperature liquefied gas with these components will not cause the liquefied gas to abruptly expand (vaporized). As a result, formation of dusts is reduced. The mixture of the ice particles 30 and the vaporized gas fed to jet nozzle 9 therefore includes less dust. As a result, the effect of rinsing wafer 6 is enhanced.

Although in the above described embodiment, a description was made of a case in which liquid nitrogen gas is employed, the present invention is not limited thereto but may suitably employ liquid oxygen, liquid nitrogen, liquid helium, etc.

As is described in the foregoing, since the wafer rinsing apparatus according to the first aspect of the present invention includes a separation means for separating ice particles and vaporized gas generated from a low-temperature liquid gas, particles formed from dusts are removed together with the vaporized gas and separated from the ice particles. Therefore, the ice particles have no particles mixed. As a result, the ice particles fed to a jet nozzle include no dust, which enhances a wafer rinsing effect.

With an ice making hopper, a filter means and a cooling means for externally cooling a supply piping down to a liquefidation temperature of a low-temperature liquefied gas, contact of the liquefied gas with these components will not abruptly expand the liquefied gas in this wafer rinsing apparatus according to the second aspect of the present invention. Formation of dusts is suppressed accordingly. As a result, a mixture of ice particles fed to a jet nozzle and a vaporized gas includes less dust, which increases a wafer rinsing effect.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A wafer rinsing apparatus including:

an ice making hopper for making ice particles by heat exchange between fine droplets of liquid to be frozen and a low-temperature liquefied gas, separating means connected to said ice making hopper for separating said ice particles and vaporized gas generated from said low-temperature liquefied gas, jetting means for jetting said ice particles separated by said separating means toward a wafer to rinse the surface of said wafer, particle removing means attached to said separating means for removing particles from said vaporized gas separated by said separating means, and mixing means attached to said separating means, said particle removing means and said jetting means for mixing said ice particles separated by said separating means with said vaporized gas with said particles removed by said particle removing means and feeding the mixture to said jetting means.

2. The wafer rinsing apparatus according to claim 1, wherein said separating means includes a cyclone.

3. A wafer rinsing apparatus including:

an ice making hopper for making ice particles by heat exchange between fine droplets of liquid to be frozen and low-temperature liquefied gas, liquid to be frozen supplying means attached to said ice making hopper for supplying said fine droplets of said liquid to be frozen to the ice making hopper, filtering means attached to said ice making hopper for removing particles included in said low-temperature liquefied gas supplied to the ice making hopper, a supply piping coupled to said filtering means for supplying a low-temperature liquefied gas to said ice making hopper through said filtering means, jetting means for jetting said ice particles formed by said ice making hopper onto a wafer, and cooling means for externally cooling said ice making hopper, said filtering means and said supply piping down to a liquefidation temperature of said low-temperature liquefied gas.

4. The wafer rinsing apparatus according to claim 3, wherein said cooling means includes a cooling chamber for housing said ice making hopper, said filtering means and said supply piping, said cooling chamber being filled with low-temperature liquefied gas.

* * * * *